United States Patent [19]

Martin et al.

[11] 4,251,031

[45] Feb. 17, 1981

[54] VIBRATORY ATOMIZER

[75] Inventors: Barrie J. Martin, Shenfield; Dennis Harvey, Tilbury; Peter Stanwell, Wansteed, all of England

[73] Assignee: Plessey Handel and Investments AG, Zug, Switzerland

[21] Appl. No.: 51,186

[22] Filed: Jun. 22, 1979

[30] Foreign Application Priority Data

Jul. 11, 1978 [GB] United Kingdom ..... 29478/78

[51] Int. Cl.[3] ..... B05D 3/14

[52] U.S. Cl. ..... 239/102; 123/538; 261/DIG. 48; 310/326; 310/345; 310/348

[58] Field of Search ..... 123/32 JV, 32 AE, 119 EE; 239/102, 600; 261/DIG. 48; 310/311, 325, 326, 327, 345, 348

[56] References Cited

U.S. PATENT DOCUMENTS

| | | | |
|---|---|---|---|
| 2,949,900 | 8/1960 | Bodine | 239/102 X |
| 3,400,892 | 9/1968 | Ensminger | 239/102 |
| 4,052,004 | 10/1977 | Martin et al. | 239/102 |

*Primary Examiner*—Andres Kashnikow

*Attorney, Agent, or Firm*—Fleit & Jacobson

[57] ABSTRACT

An arrangement for supporting a vibratory atomizer for liquids, in which a nozzle for ejecting the liquid forms the end of a longitudinal passage in a decreasing-diameter resonant vibration-amplifier horn that extends from a body portion equipped with a generator for longitudinal vibrations, in a supporting structure with a minimum of interference with either the longitudinal vibrations or radial vibrations which accompany these longitudinal vibrations. The atomizer is clamped axially between two annular resilient support members one of which acts upon a flange-like shoulder surface of the atomizer perpendicular to the longitudinal vibration at the larger-diameter base of the amplifier horn and permits relatively unrestricted radial movement of the shoulder surface, while the other engages the horn surface in the vicinity of this plane along a line at which the horn surface intersects a nodal zone of zero radial vibration, where it acts to centralize the atomizer in addition to supporting it axially. Both annular supporting members may be formed as O-ring seals, and the space between the two O-ring seals may be utilized as a chamber through which liquid is supplied to the axial bore via a passage leading to that bore from the surface of the horn.

12 Claims, 5 Drawing Figures

VIBRATORY ATOMIZER

This invention relates to a vibratory atomiser for atomising a liquid such for example as liquid fuel for an engine or a heat exchange boiler.

It is difficult in practice to determine accurately the vibration node of a vibratory atomiser. The vibratory node is required to be determined so that the atomiser may be rigidly secured in the region of the vibration node to an associated mounting. Because there is virtually no vibration at the vibration node, little or no energy is thus lost from the atomiser into the mounting during periods when the atomiser is being vibrated.

Hitherto, it has been customary only to take into account vibrations in the longitudinal direction of the atomiser. Radial vibrations and radial movement due to Poissons ratio effect have hitherto usually been neglected. Since the radial vibrations and radial movements are neglected, energy loss from the atomiser to its mounting occurs. In U.S. Pat. No. 4,052,004 by Martin and another, which has been assigned to the Assignees of the present application, it has been proposed to reduce the energy losses previously resulting from the transmission of longitudinal and radial vibrations to the structure in which the atomiser is supported, by supporting the atomiser in the supporting structure by a single O-ring or similar resilient annular member. While this O-ring can be fitted in a nodal zone of the longitudinal vibrations, and the O-ring can yield radially to permit radial vibrations of the atomiser surface relative to the supporting structure, difficulties have in practice arisen because of the different locations of the respective nodes of radial and longitudinal vibration, so that in practice radial vibration energy will be transmitted from the atomiser to the supporting structure via the O-ring.

It is an aim of the present invention to minimise or further reduce the energy loss from the atomiser to its mounting by taking into account the radial vibrations and radial movement of the atomiser.

Accordingly, this invention provides a vibratory atomiser for atomising a liquid, which atomiser comprises a nozzle portion from which the liquid is ejected, a body portion having vibration means, a flange separating the nozzle portion and the body portion, a housing positioned around the body portion, a supporting and centering member such as a ring seal mounted on the nozzle portion at a nodal point of substantially zero longitudinal and radial vibrations in use of the atomiser, and pressure means for applying pressure in the longitudinal direction of the atomiser, while permitting relatively free radial movement, at a nodal zone of the longitudinal vibrations for causing the ring seal to sealingly engage the nozzle portion and a mounting surface.

Preferably, the ring seal is an O-ring seal. For high pressure applications, the O-ring seal may be made of copper.

Also preferably, the pressure means is a ring seal, for example an O-ring seal. For high pressure applications, the O-ring seal may be made of copper. In an alternative embodiment of the invention, the pressure means may be a spring wire device. By way of example only, it is mentioned that the spring wire device may be a hexagonal spring wire device.

The vibratory atomiser may have a liquid inlet constituted by a liquid inlet pipe. Preferably, the liquid inlet pipe is attached to the body portion and it is made a number of half wave lengths long for the speed of sound in the pipe, whereby in use of the vibratory atomiser energy radiated into the pipe reflects back into the body portion in phase.

Usually, a flexible liquid inlet tube will be clamped to the pipe. This pipe may be, for example, a rubber or a plastics pipe.

Preferably, the pipe is constructed to be one wave length long. In this case, the tube may then be clamped to the pipe by a clamp positioned at a quarter or three quarters of a wave length from the point of attachment of the pipe to the body portion. Alternatively, and if desired, the pipe may be one wave length long and it may be secured to a mounting device such as an engine fuel manifold by an O-ring positioned at a quarter or three quarters of a wave length from the point of attachment of the pipe to the body portion. Advantageously, the O-ring is a rubber O-ring.

In another embodiment of the invention, the liquid inlet to the vibratory atomiser is constituted by one or more liquid passageways positioned between the ring seal and the pressure means.

As indicated above, the mounting surface may be a part of an engine manifold, a part of a heat exchange boiler, or part of the housing of the atomiser.

Usually, the vibration means will be a piezoelectric crystal device but it is to be appreciated that other vibration devices such for example as an electro magnetic device may be employed.

The atomiser is preferably such that it has a ball valve obturator effective to prevent ejection of the liquid from the atomiser when the body portion is not being vibrated. The ball valve obturator can be located inside or outside the nozzle portion. If a ball valve or other obturator is not employed, then in some circumstances a solid jet of liquid can be ejected from the atomiser and collected and recirculated until such time as atomisation of the liquid is required when the vibration means will be activated.

The vibratory atomiser of the present invention may be used to inject fuel into an engine of a vehicle. It may be also be used to inject fuel into a heat exchange boiler, for example for use in central heating systems. Examples of other liquids that may be atomised are various chemicals and paints.

Usually, the vibratory atomiser will be vibrated with ultrasonic vibrations. In practice, the lower limit of these ultra-sonic vibrations may be near the upper limit of audibility to the human ear. However, it is desirable that the vibrations will be of such frequency that they cannot normally be heard by the human ear, thereby avoiding undue noise.

Embodiments of the invention will now be described solely by way of example and with reference to the accompanying drawings in which.

Figure 1:
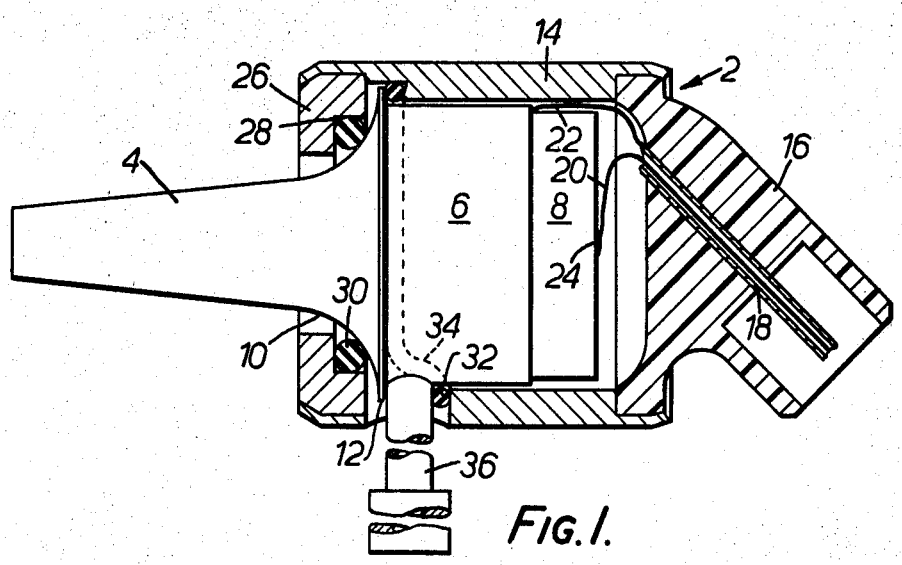
FIG. 1 shows a first embodiment of the invention.

Referring to FIG. 1, there is shown a vibratory atomiser 2 for atomising a liquid. The atomiser 2 comprises a nozzle portion 4 from which the liquid is ejected, and a body portion 6 having vibration means in the form of a piezo electric crystal 8. As shown in FIG. 1, the nozzle portion 4 has a curved surface 10 of reducing diameter to constitute a vibration amplifier horn. A flange 12 formed integrally with the atomiser provides between the nozzle portion 4 and the body portion 6 a shoulder facing away from the tip of the horn.

A housing 14 is positioned around the body portion 6 as shown and this housing 14 has a portion 16 provided with conduit means 18 for receiving electric leads 20, 22 for activating the crystal 8. As shown in FIG. 1, the lead 20 is attached to the crystal 8 at 24.

The housing 14 has a front portion 26 and this front portion 26 could also be, if desired, part of a body such for example as an engine in which the atomiser 2 is to be mounted. It will be seen from FIG. 1 that the portion 26 is provided with a recessed part 28 in which a rubber O-ring 30 sits. The O-ring 30 then bears against the curved surface 10 of the nozzle portion 4.

In order that the O-ring 30 acts as an effective sealing member, it is necessary for pressure to be applied in the longitudinal direction of the atomiser 2 (from right to left as shown in FIG. 1) so that the O-ring 30 is effectively pressed between the part 28 and the curved surface 10. This required pressure is provided by pressure means in the form of a rubber O-ring 32. The ring 32 is curved at 34 to allow a liquid inlet pipe 36 to be connected to the body portion 6.

Figure 2:
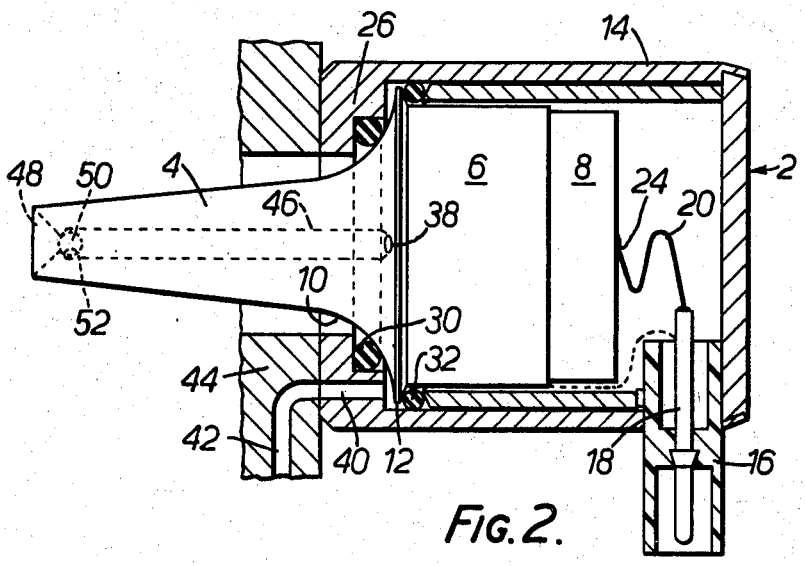
FIG. 2 shows a second embodiment of the invention.

Referring now to FIG. 2, similar parts as in FIG. 1 have been given the same reference numeral and their precise construction and operation will not again be given in order to avoid undue repetition. In FIG. 2, the liquid inlet pipe 36 has been dispensed with and liquid inlet passageways have been provided in the nozzle portion 4, one of these passageways being illustrated as passageway 38. Fuel enters the passageway 38 by means of a passageway 40 formed in the front portion 26 of the housing 14 and a passageway 42 formed in part of a manifold 44, for example of an engine (not shown).

In FIG. 1, liquid passes along the pipe 36 to the nozzle portion 4. In FIG. 2, liquid passes along the passageways 42, 40 and, via the chamber formed between the O-ring seals 30, 32, and via the passageway 38, to the nozzle portion 4. Preferably, the liquid in the nozzle portion 4 passes to inlet 48 along a passageway 46 (which is only shown in FIG. 2). This liquid is normally prevented from escaping from the nozzle outlet 48 by means of a ball valve obturator 50 which normally rests on a seat 52 as shown in FIG. 2. When the crystal 8 is activated, the tip of the nozzle portion 4 is caused to vibrate longitudinally and this knocks the obturator 50 off its valve seat 52 and thus opens the outlet 48 for ejection of the liquid.

Figure 3:
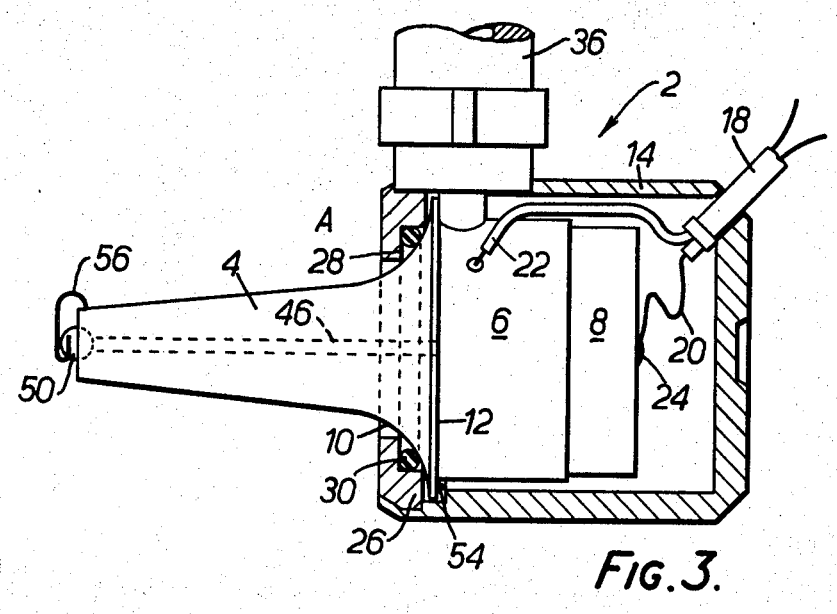
FIGS. 3 and 4 show a third embodiment of the invention.
Figure 4:
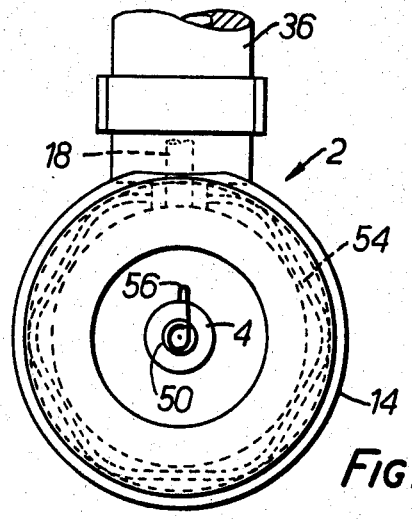

In FIGS. 3 and 4, in which similar parts as in FIG. 1 have again been given the same reference numerals, the O-ring 32 has been replaced by a hexagon spring locator 54. Obviously, the spring locator 54 does not seal at this point but it is still effective to push the curved surface 10 against the O-ring seal 30 and the recessed part 28 to cause a seal at this point. A seal at the position of the spring locator 54 is not required because, similarly to the embodiment shown in FIG. 1, liquid is introduced to the passageway 46 by means of a liquid inlet pipe 36.

Also in FIGS. 3 and 4, the ball valve obturator 50 has been positioned outside the nozzle portion 4 and is held in position by a spring 56.

Figure 5:
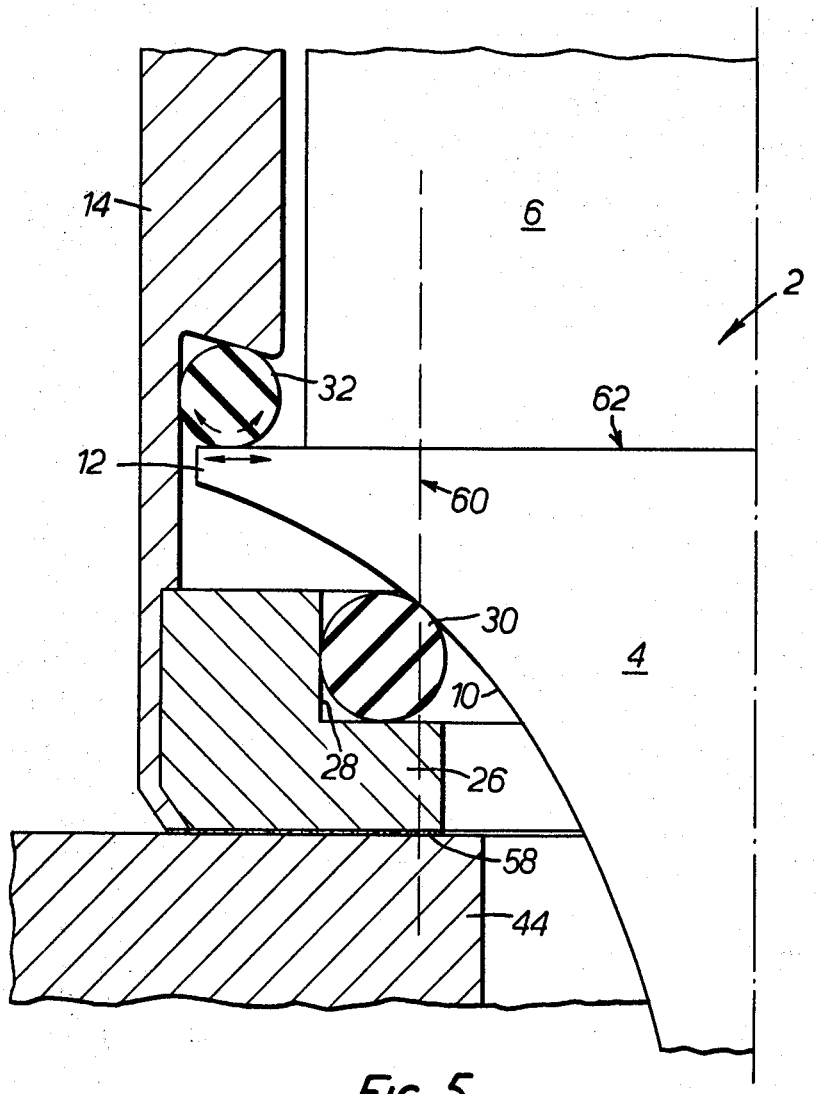
FIG. 5 is a detailed drawing showing how one embodiment of the invention works.

Referring now to FIG. 5, part of an atomiser 2 is shown secured to a manifold 44, there being a gasket 58 sealingly positioned between the housing front portion 26 and the manifold 44. The node of zero radial vibration of the atomiser is shown at 60 and its node of zero longitudinal vibration is shown at 62. The nodal zones 60, 62 have been determined practically by experiment. The shoulder surface of flange 12 is arranged in the zone 62 of zero longitudinal vibrations so that the O-ring will not transmit any longitudinal vibration energy, while any radial movement of the flange 12 merely causes the O-ring 32 to roll as indicated by the arrows and little energy is lost. At the same time, the O-ring 32 is effective to apply the necessary longitudinal pressure through the flange 12 onto the O-ring 30 for causing a seal to be formed at the line of intersection of the horn surface with a zone of zero radial vibration, thus avoiding problems which would be caused by the transmission of radial vibrational energy.

It is to be appreciated that the embodiments of the invention described above have been given by way of example only and that modifications may be effected. Thus, for example, the cross sectional shape of the O-rings 30, 32 can be varied. Also, a different construction of spring locator 54 can be employed. Further, in some instances, the ball valve obturator 50 can be dispensed with and a solid jet of liquid can be ejected from the outlet 48 and collected and recycled until such time as the crystal 8 is vibrated to cause the required atomisation.

We claim:

1. A vibratory atomising arrangement for atomising a liquid, which comprises:

(a) an atomiser including a body portion determining a longitudinal direction and equipped with means for generating vibrations of the body portion in this longitudinal direction, and a decreasing-diameter resonant vibration-amplifier horn whose larger-diameter base joins the body portion in a nodal plane of the thus generated longitudinal vibrations, the atomiser being formed with a flange-like shoulder arranged in said nodal plane and facing away from the smaller-diameter tip of the horn, and the horn having an internal longitudinal passage for the liquid to be atomised, terminating in a nozzle at the tip of the horn, and (b) means for supporting and locating the atomiser in a supporting structure, the supporting means including (1) a resilient annular supporting and centering member which is interposed between the horn and such supporting structure and engages the outer surface of the horn in a zone which is in the vicinity of said nodal plane, and in which said surface intersects a nodal zone of the radial vibrations which arise in the atomiser simultaneously with said longitudinal vibrations, and (2) a further resilient annular supporting member which is interposed between said shoulder and the supporting structure to exert upon the atomiser an axial force directed towards said supporting and centering member and thus to clamp the atomiser longitudinally between said further supporting member and said supporting and centering member while permitting relatively unrestricted radial movement of the shoulder surface.

2. An arrangement as claimed in claim 1, in which the resilient annular supporting and centering member is constructed as a ring seal.

3. An arrangement as claimed in claim 2, in which the further annular supporting member is also formed as a ring seal.

4. An arrangement as claimed in claim 3, which includes a supporting structure which, jointly with the atomiser and the two ring seals respectively constituting said supporting and centering member and said further supporting member, forms a sealed chamber, the atomiser having a bore interconnecting said chamber with the longitudinal passage in the horn while the supporting structure has a passage leading to said chamber and capable of being connected to a liquid supply.

5. An arrangement as claimed in claim 1, in which the shoulder is formed by the combination of the body portion with an amplifier horn whose base diameter is greater than the adjacent diameter of the body portion but small enough to be clear of any surrounding portion of the supporting structure.

6. An arrangement as claimed in claim 1, in which the resilient annular supporting and centering member is formed as an O-ring seal.

7. An arrangement as claimed in claim 1, claim 3 or claim 4, in which the further annular supporting member is formed as an O-ring seal.

8. An arrangement as claimed in claim 1, in which the body portion is equipped with a liquid-inlet pipe projecting from the circumference of the body portion and communicating with the longitudinal passage of the horn, the length of this pipe being an integral number of half-wavelengths of such radial vibrations.

9. An arrangement as claimed in claim 8, in which a flexible tube is clamped to the pipe by a clamp positioned at one quarter or three quarters of a wavelength from the surface of the body portion.

10. An arrangement as claimed in claim 8, in which the pipe is secured to such supporting structure by an O-ring positioned one quarter or three quarters of a wavelength from the surface of the body portion.

11. A vibratory atomiser according to claim 8 in which the vibration means is a piezoelectric crystal device.

12. A vibratory atomiser according to claim 11 having a ball valve obturator effective to prevent ejection of the liquid from the atomiser when the body portion is not being vibrated.

* * * * *